US006536929B1

(12) United States Patent
Forgács et al.

(10) Patent No.: US 6,536,929 B1
(45) Date of Patent: Mar. 25, 2003

(54) INCANDESCENT LAMP FOR USE IN A REFLECTOR

(76) Inventors: László Forgács, 6913 Csanádpalota, Szent István u. 92 (HU); István Kerényi, 1046 Budapest, Nádor u. 45 (HU)

( * ) Notice: Subject to any disclaimer, the term of this patent is extended or adjusted under 35 U.S.C. 154(b) by 0 days.

(21) Appl. No.: 09/644,756

(22) Filed: Aug. 23, 2000

(51) Int. Cl.[7] ..... F21V 19/00

(52) U.S. Cl. ..... 362/519; 362/197; 362/226; 362/249

(58) Field of Search ..... 362/252, 197, 362/800, 806, 249, 519, 226

(56) References Cited

U.S. PATENT DOCUMENTS 5,186,535 A * 2/1993 Yokoyama ..... 362/226

6,260,986 B1 * 7/2001 Helbig et al. ..... 362/519

* cited by examiner

*Primary Examiner*—Sandra O'Shea
*Assistant Examiner*—Guiyoung Lee

(57) ABSTRACT

An incandescent lamp for use in a reflector is provided. The incandescent lamp comprises an envelope with a longitudinal axis, at least one filament and electrical lead-out wires. The lamp has a support portion receiving the envelop, a sleeved optical disc associated operatively with the support portion. The sleeved optical disc has a cut-out in a mantle thereof. A plastic base belongs to the incandescent lamp anchoring the sleeved optical disc and includes terminals. A leaf-spring is bent substantially to an O-shape and located in a space defined by the mantle of the sleeved optical disc. The leaf-spring includes a tongue protruding from one portion of the O-shape. The leaf-spring has two end portions forming a tab protruding from another portion of the O-shape. The leaf-spring is pressed to an inner portion of the mantle of the sleeved optical disc at the tab so that the tongue extends through the cut-out in the mantle of the sleeved optical disc.

8 Claims, 3 Drawing Sheets

INCANDESCENT LAMP FOR USE IN A REFLECTOR

FIELD OF THE INVENTION

This invention relates to an incandescent lamp for use in a reflector, and, more particularly, to an incandescent lamp to be fixed in a focused position in the reflector.

BACKGROUND OF THE INVENTION

Incandescent lamps used in automotive reflectors are fixed in the reflectors as replaceable lamp assemblies in such a way that the reflector and the lamp form a closed unit in which a sealing rubber prevents humidity or dust from penetrating into the reflector. The incandescent lamp is equipped with locking elements constituting detachable joints with the elements formed in the wall of the reflector. The envelope of the incandescent lamp is set inside the reflector, while the terminals providing connection to the electrical circuit of the automobile are set outside of the reflector. The incandescent lamp must be fixed in the reflector so that the filament of the incandescent lamp takes a precisely defined position in the reflector-envelope otherwise the beam would deviate from the applicable standards. The incandescent lamp must keep this optical position during the operation, that is impacts and vibrations of the automobile must not dislocate the lamp from its position described above. At the same time, the fixing must be detachable so that the incandescent lamp can be replaced in the event of its defect. According to the effective IEC Standard No. 60061-2, the fixing is accomplished with a springy locking element pressing the incandescent lamp into the so-called V-supports shaped in the wall of the reflector by at least 10 N force. The locking element is simultaneously wedged in an indent shaped in the wall of the reflector.

A vehicle headlamp system is described in U.S. Pat. No. 5,855,430 comprising an optical reflector and an incandescent lamp. The optical reflector has an optical surface, which faces a forward direction, and a wall defining an opening formed therethrough. The reflector wall includes an axial positioning surface and a planar positioning surface. The lamp includes a light source with an envelope and a pinched portion, a sleeved optical disc having a metal support sleeve and a metal support portion. The metal support portion couples with the light source adjacent the pinched portion. A plastic bass, fixedly holds the sleeved optical disc, and has passages formed to pass the electric lead-outs through the plastic base to couple with terminals held by the plastic base, too. The headlamp system additionally includes a spring positioned to act between the internal reflector wall and the lamp so as to press between the reflector and the lamp in a direction orthogonal to the lamp axis. The spring comprises a resilient section of curved metal between two feet located in a cavity formed in the lamp. The feet act as guides to retain and direct the action of the spring. When the inner foot is properly positioned, the outer foot can slide in the cavity by the spring force and thereby apply pressure through its contact face that can slide and press on the internal reflector wall. Fixing the lamp in the opening of the reflector wall with rotation, the spring is compressed by advancing against the interior reflector wall, and the side of a ramp formed on the inner side of the reflector wall, thereby exerting in a direction perpendicular to the axis of the lamp.

Another incandescent lamp applicable in automotive reflectors is described in U.S. Pat. No. 5,957,569. This lamp has a plastic base, a metal support portion and a metal support sleeve, too. The lower part of the metal support portion is attached to the metal support sleeve while its upper part is fixing the envelope of the incandescent lamp. The lower part of the metal support sleeve is embedded in the plastic base and the upper part of the sleeve is equipped with optical flanges. The filament of the lamp is connected through lead-out wires to terminals which can be connected to the electrical circuit of the automobile. The incandescent lamp is fixed in the reflector by placing the lamp in the opening at the rear end of the reflector, while the optical flanges penetrate into the grooves shaped in the opening of the reflector and designed to match these optical flanges. Then the lamp is twisted around its longitudinal axis while the incandescent lamp is fixed in the reflector. Fixing is provided for by a compression spring which, in one of the embodiments, is welded to the outer wall of the metal support sleeve with one end, while the other end is resting free on the outer wall of the metal support sleeve. The middle of the compression spring constitutes a flare resting on the rim of the opening of the reflector when the lamp is twisted in the reflector.

In an other embodiment, the compression spring is designed as a flaring leafspring, but its ends are placed into the apertures between the metal support sleeve and the plastic base. The flaring portion of the leaf-spring protrudes outside of the outer wall of the metal support sleeve. When the flaring portion of the leaf-spring is compressed in the course of fixing the incandescent lamp in the reflector, the ends of the leaf-spring slide deeper into the apertures, while the. flaring part abuts along the opening of the reflector as described above.

In a further configuration, the flaring leaf-spring protrudes through a breach formed in the wall of the metal support sleeve under one of the three optical flanges. The ends of the leaf-spring rest on the bumpers designed on the metal support sleeve and the plastic base so that the leaf spring is compressed between these two bumpers also designed as supports.

In all the above cases, the compression spring is made from spring steel, which must be bent to provide the required shape, and it reaches the final shape when the lamp is fixed in the reflector. Since the length of the spring is relatively short, the stress occurring within the metal is relatively high. Metal s made of steel and capable of providing sufficient spring force has to be resilient in order to avoid irreversible distortion. During the compression of a spring, the stress in the metal must not exceed the elastic limit and come to overstrain. The stress in the metal depends on the geometry and the quality of the material. In one hand, there are steel materials with excellent spring characteristics but their stain resistance is not suitable for use in an automotive lamp. In the other hand, there is spatial limitation for the geometry of a spring in an automotive lamp. This limitation refers to the length of the spring which, despite the restricted room in the lamp inside, has to be long enough in order to present sufficient elasticity. Springs applied in the above cases have relatively short lengths thus the stress in the springs are close to the elastic limit.

Thus there is a particular need for an incandescent lamp, preferably for an automotive lamp, the leaf-spring of which used for fixing in a reflector is stainless however has a good springing, and can be manufactured and mounted into the lamp easily.

SUMMARY OF THE INVENTION

In an exemplary the embodiment of the invention, an incandescent lamp for use in a reflector is provided. The incandescent lamp comprises an envelope with a longitudinal axis, at least one filament and electrical lead-out wires. The lamp has a support portion receiving the envelop and a sleeved optical disc associated operatively with the support portion. The sleeved optical disc has a cut-out in a mantle thereof. A plastic base belongs to the incandescent lamp anchoring the sleeved optical disc and includes terminals. A leaf-spring is bent substantially to an O-shape and located in a space defined by the mantle of the sleeved optical disc. The leaf-spring includes a tongue protruding from one portion of the O-shape. The leaf-spring has two end portions forming a tab protruding from another portion of the O-shape. The leaf-spring is pressed to an inner portion of the mantle of the sleeved optical disc at the tab so that the tongue extends through the cut-out in the mantle of the sleeved optical disc.

An incandescent lamp in combination with a reflector is also provided, where the tongue is engaged in an indent formed in an opening of a wall of the reflector after the incandescent lamp is fixed therein.

The advantage of the present invention over both prior art patents quoted above is that the use of a lengthened leaf-spring bent to an O-shape requires less stress in the material of the spring even if it is pre-pressed when -mounted in the lamp. Owing to the less stress arising in the spring, a more suitable spring material can be selected with due regard to stain resistance. Moreover, the spring can be manufactured and mounted in the lamp easily.

DETAILED DESCRIPTION OF THE INVENTION

Figure 1:
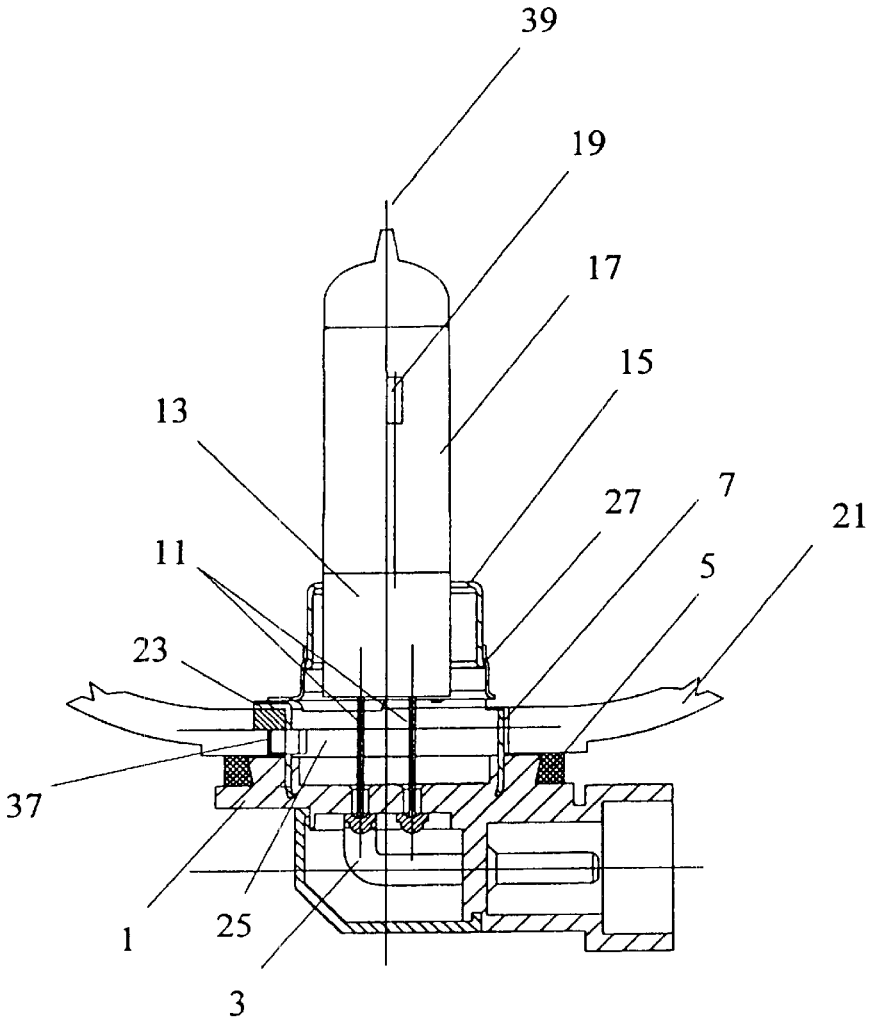
FIG. 1 is an axial-sectional view of an incandescent lamp and a part of a reflector wall, in which the present invention is embodied.
Figure 2:
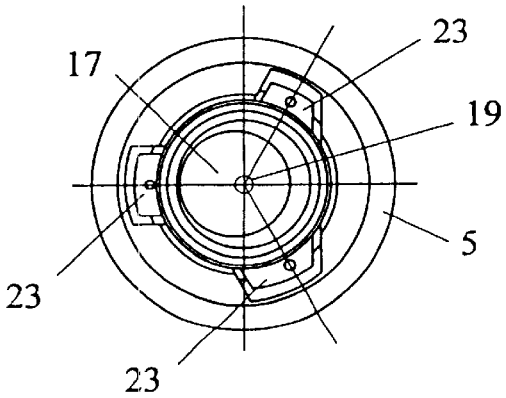
FIG. 2 is a top view of the incandescent lamp of FIG. 1.

Referring now to FIGS. 1 and 2, a replaceable incandescent lamp is shown in which the present invention is embodied. The lamp is preferably a halogen incandescent lamp such as a lamp of H8, H9, H11 type or the like which is recently used in this area of technology. The incandescent lamp has an envelope 17 with a pinched portion 13 at one end thereof, a filament 19 and a pair of lead-out wires 11 which supply electric current to the filament 19. The lead-out wires 11 are welded to electrical terminals 3 integrally mounted in a plastic base 1. The envelope 17 of the lamp is held firmly at its pinched portion 13 by a metal support portion 15 which is welded to a sleeved optical disc 7 made of metal and embedded in the plastic base I through a metal support sleeve 27. The incandescent lamp is combined with a reflector, the rear end of which is shown around the lamp. The incandescent lamp is secured in the opening of the reflector wall 21 in a fixed position.

Fixing is provided for by a tongue 37 of a leaf-spring 25 which flexibly snaps into an appropriate indent of the reflector wall 21 thus preventing the incandescent lamp from twisting even during vibrations. The incandescent lamp is prevented from moving axially 39 by three optical flanges 23 formed on the sleeved optical disc 7 from one direction, and by a sealing rubber 5 drawn on the plastic base I from the other direction. Putting the incandescent lamp into the opening of the reflector wall 21, the right position is oriented by the three optical flanges 23 which fit into the indents formed to a similar shape in the opening of the reflector wall 21. In order to prevent false placement, each of the three 23 optical flanges has a different shape and the same applies to the indents formed in the opening of the reflector wall 21. After putting the incandescent lamp in the reflector axially 39, the lamp is twisted and fixed in the required position, i.e. the leaf-spring 25 makes the outer surface of the sleeved optical disc 7 of the incandescent lamp lean against the V-supports shaped in the wall of the reflector.

Figure 3:
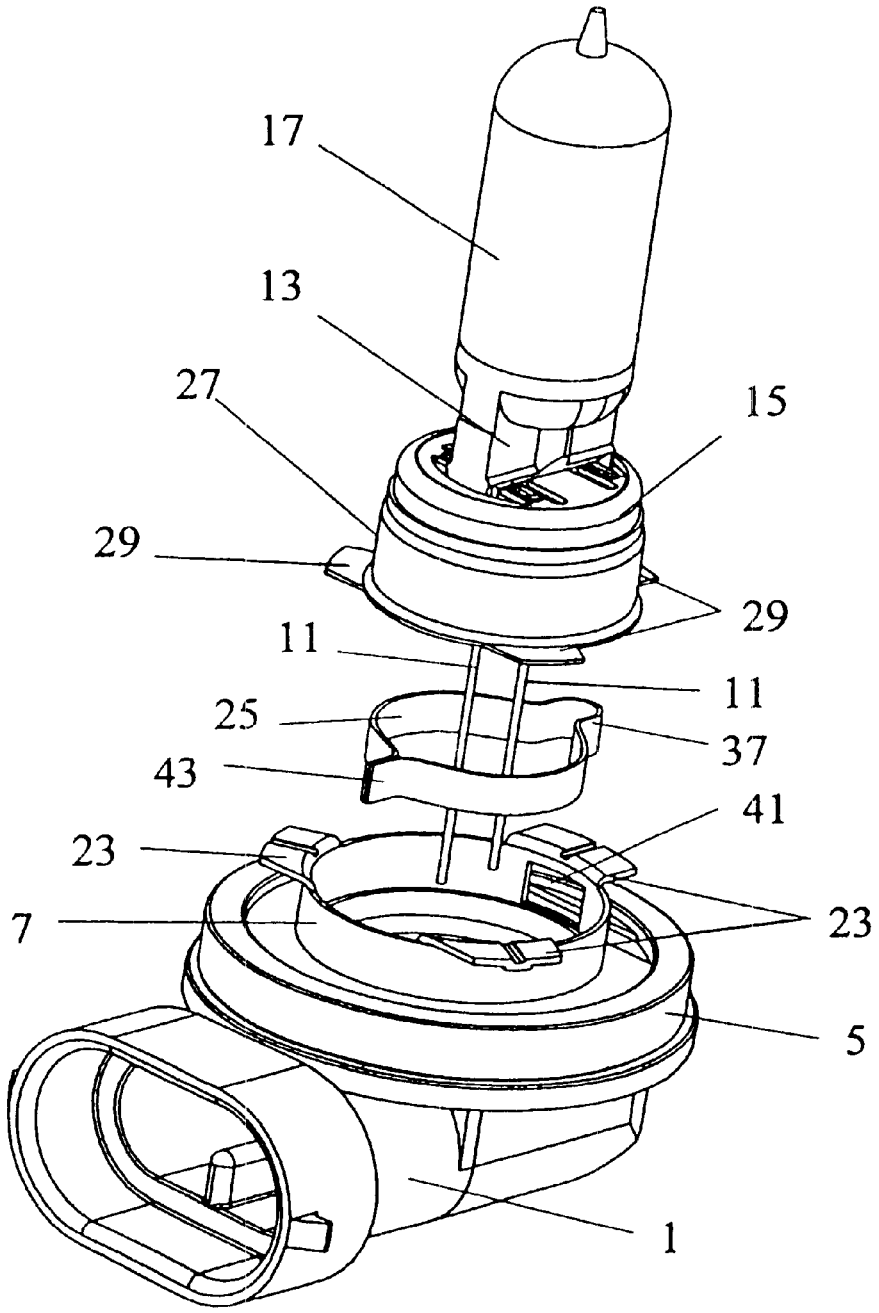
FIG. 3 is an exploded view of the incandescent lamp of FIG. 1.

For the sake of a better understanding, FIG. 3 shows the components of the incandescent lamp separately at an intermediate stage of assembly. The metal support portion 15 is composed for supporting the envelope 17 the pinched portion 13 of which has a substantially rectangular cross section. So the metal support portion 15 is provided with an aperture in response to the shape of the outer peripheral surface of the pinched portion 13 of the envelope 17. The metal support portion 15 can be fastened to the metal support sleeve 27 by its mantle because the outer diameter of the metal support portion 15 is substantially equal to or slightly smaller than the inner diameter of the metal support sleeve 27. The metal support sleeve 27 has three flanges 29 extending at the peripheral edge thereof in a radial direction. The metal support portion 15 in which the envelope 17 is fixed and the metal support sleeve 27 are welded together in a positioning operation in order to dispose the filaments of the lamp at a suitable axial position in the reflector. In this position, the filament of the incandescent lamp will engage the predetermined focus position along the axis 39 of the lamp. The flanges 29 of the metal support sleeve 27 will be welded to the optical flanges 23 of the sleeved optical disc 7 ensuring the correct radial position of the filament, too. Before welding, the leaf-spring 25 has to be placed in the sleeved optical disc 7. As it is seen in the figure, the leaf-spring 25 is bent substantially to an O-shape and is located in a space defined by the mantle of the sleeved optical disc 7. The tongue 37 of the leaf-spring 25 protrudes from one portion of the O-shape. The leaf-spring 25 has two end portions forming a tab 43 protruding from another portion of the O-shape. During the assembly, the leaf-spring 25 is pressed to an inner portion of the mantle of the sleeved optical disc 7 at the tab 43 so that the tongue 37 extends through a cut-out 41 in the mantle of the sleeved optical disc 7. The cut-out 41 is an aperture with a rectangular shape corresponding to the width and height of the tongue 37. The lead-out wires 11 run through the space surrounded by the O-shape avoiding any contact to the inner surface of the leaf-spring 25. After the incandescent lamp is fixed in the reflector, the tongue 37 is engaged in an indent formed in the opening of the reflector wall 21. In this fixed position, the sealing rubber 5 prevents the humidity and dust from penetrating into the reflector.

The plastic base 1 is formed of synthetic resin in which the sleeved optical disc 7 is embedded in such a way that the plastic of the base is molded around the lower portion of the sleeved optical disc 7. Since the figure shows an intermediate stage of assembly, the terminals 3 (shown in FIG. 1) are not inserted yet. The mechanical and electrical joining of the lead-out wires 11 and the terminals 3 will be performed at an additional stage of the assembling process.

Figure 4:
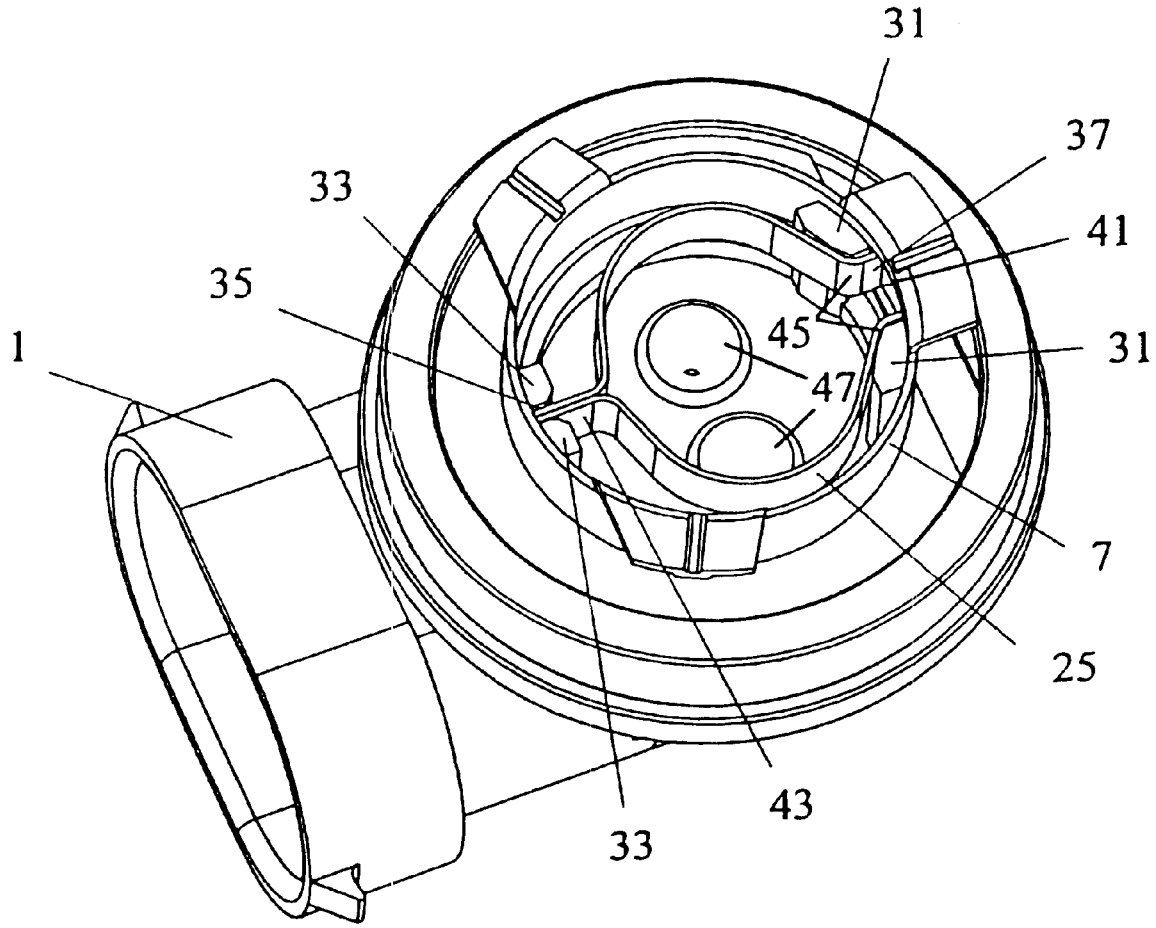
FIG. 4 is a perspective view of a part of a further embodiment of the incandescent lamp.

In FIG. 4, the plastic base 1 of another embodiment of the incandescent lamp is shown. The shape of the leaf-spring 25 is similar to that in FIG. 3, so it cannot come into contact with the lead-out wires even in the event that the leaf-spring is pressed. Furthermore, it is expedient to leave a clearance between the leaf-spring 25 and the sleeved optical disc 7 which is sufficient for the deformation of the leaf-spring 25. If the leaf-spring 25 seated on the inner side of the sleeved optical disc 7, this would significantly reduce its resilience. Two protrusions 31 are formed of the plastic base 1 located between the mantle of the sleeved optical disc 7 and two transitional sections 45 of the leaf-spring 25. The transitional sections 45 join the tongue 37 and the O-shaped part of the leaf-spring 25. The leaf-spring 25 leans against the protrusions 31 at the transitional sections 45 pre-stressing the leaf-spring 25 with a pre-determined force. The protrusions 31 extend substantially parallel to the longitudinal axis of the lamp at two sides of the cut-out 41 in the mantle of the sleeved optical disc 7. It is desirable to determine the shape of the plastic base 1 and the size of the leaf-spring 25 so that the leaf-spring 25 can be placed in the plastic base 1 in a pre-pressed state. As it is seen in the figure, the tab 43 of the leaf-spring 25 is inserted into a slit 35 formed by portions 33 of the plastic base 1 protruding into the inner space defined by the mantle of the sleeved optical disc 7. These portions 33 hold the tab 43 of the leaf-spring 25 firmly on the inner wall of the sleeved optical disc 7 preventing it from sliding along the inner wall of the sleeved optical disc 7. In the bottom of the plastic base 1, two guiding funnels 47 are formed in order to allow the lead-out wires to get through the bottom of the plastic base 1 during the assembling process.

Computational analysis and measurements were carried out in order to compare the characteristics of the leaf-spring 25 with the spring described in U.S. Pat. No. 5,957,569 mentioned above. The table below shows the results of the analysis of the two different springs. Spring No. 1 is the prior art spring; Spring No. 2 is the leaf-spring 25 of the incandescent lamp in which the present invention is embodied. In the computational analysis, the thickness of both springs was 0.3 millimeter.

| | Compression | Force | Stress generated in the material |
|---|---|---|---|
| Spring No. 1 | 0.62 mm | 25 N | 1320 Mpa |
| Spring No. 2 | 1.25 mm | 17 N | 960 Mpa |

The result shows that the stress generated in Spring No. 2 is much less than that in Spring No. 1 although Spring No. 2 was compressed two times the compression of Spring No. 1.

In order to validate the computational analysis, Spring No. 2 was placed in the plastic base 1 so that it was pre-compressed by 0.4 millimeter and the change in compression of the spring was measured as a function of force. Measurement results are shown in the table below.

| Force (N) | Compression (mm) |
|---|---|
| 2.4 | 0.06 |
| 4.7 | 0.11 |
| 5.9 | 0.14 |
| 7.1 | 0.16 |
| 8.3 | 0.18 |
| 9.5 | 0.21 |
| 10.7 | 0.25 |
| 11.9 | 0.29 |
| 13.6 | 0.43 |
| 14.7 | 0.52 |
| 15.9 | 0.62 |
| 17.1 | 0.74 |

-continued

| Force (N) | Compression (mm) |
|---|---|
| 18.3 | 0.89 |
| 19.5 | 1.08 |
| 20.7 | 1.18 |

Looking at the force of 17.1 N in the table, the measured compression of the spring was 0.74 millimeter. Taking into account the 0.4 millimeter pre-compression, the total compression is 1.14 millimeter. This value is close to the result of the computational analysis which was 1.25 millimeter. In the case of H8, H9, H11 lamps, the applicable standard requires a minimum of 10 N compression force so that the lamp can be properly locked in the opening of the reflector. Based on the measurement results, this requirement can be met with the leaf-spring 25.

What is claimed is:

1. An incandescent lamp for use in a reflector comprising:

an envelope having a longitudinal axis, at least one filament, and electrical lead-out wires;

a support portion receiving the envelop;

a sleeved optical disc associated operatively with the metal support portion and having a cut-out in a mantle thereof;

a plastic base anchoring the sleeved optical disc and including terminals;

a leaf-spring bent substantially to an O-shape and located in a space defined by the mantle of the sleeved optical disc;

the leaf-spring including a tongue protruding from one portion of the O-shape;

the leaf-spring having two end portions forming a tab protruding from another portion of the O-shape;

the leaf-spring being pressed to an inner portion of the mantle of the sleeved optical disc at the tab so that the tongue extends through the cut-out in the mantle of the sleeved optical disc.

2. The incandescent lamp of claim 1 in which the one portion from which the tongue protrudes and the other portion from which the tab protrudes are diagonally opposite to each other.

3. The incandescent lamp of claim 1 in which the tongue is bent from the material of the leaf-spring to an U-shape and transitional sections are formed between the O-shape and the U-shape.

4. The incandescent lamp of claim 1 in which the tab of the leaf-spring is inserted into a slit formed in a portion of the plastic base protruding into the inner space defined by the mantle of the sleeved optical disc.

5. The incandescent lamp of claim 1 in which the leaf-spring is pre-pressed by protrusions of the plastic base located between the mantle of the sleeved optical disc and the transitional sections of the leaf-spring.

6. The incandescent lamp of claim 5 in which the protrusions of the plastic base extend substantially parallel to the longitudinal axis at two sides of the cut-out in the mantle of the sleeved optical disc.

7. The incandescent lamp of claim 1 in which the leaf-spring surrounds the electric lead-out wires and is spaced apart therefrom for avoiding short-circuiting thereof.

8. An incandescent lamp and reflector combination comprising:

a reflector having a wall defining an opening;

an incandescent lamp including an envelope having a longitudinal axis, at least one filament, and electrical lead-out wires;

a support portion receiving the envelop;

a sleeved optical disc associated operatively with the metal support portion and having a cut-out in the mantle thereof;

a plastic base anchoring the sleeved optical disc and including terminals;

a leaf-spring bent substantially to an O-shape and located in a space defined by the mantle of the sleeved optical disc;

the leaf-spring including a tongue protruding from one portion of the O-shape;

the leaf-spring having two end portions forming a tab protruding from another portion of the O-shape;

the leaf-spring being pressed to an inner portion of the mantle of the sleeved optical disc at the tab so that the tongue extends through the cut-out in the mantle of the sleeved optical disc, and the tongue being engaged in an indent formed in the wall of the opening after the incandescent lamp is fixed in the reflector.

* * * * *